US010998159B2

(12) United States Patent
Ohe et al.

(10) Patent No.: US 10,998,159 B2
(45) Date of Patent: May 4, 2021

(54) ION GENERATOR AND ELECTRIC APPARATUS

(71) Applicant: SHARP KABUSHIKI KAISHA, Sakai (JP)

(72) Inventors: Nobuyuki Ohe, Sakai (JP); Tetsuya Ezaki, Sakai (JP); Satoshi Okano, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/861,799

(22) Filed: Apr. 29, 2020

(65) Prior Publication Data

US 2020/0357596 A1 Nov. 12, 2020

(30) Foreign Application Priority Data

May 10, 2019 (JP) ..... JP2019-090005

(51) Int. Cl.
*H01J 27/08* (2006.01)
*H01J 27/02* (2006.01)

(52) U.S. Cl.
CPC ..... *H01J 27/08* (2013.01); *H01J 27/022* (2013.01)

(58) Field of Classification Search
CPC ..... H01J 27/08; H01J 27/022
See application file for complete search history.

(56) References Cited

U.S. PATENT DOCUMENTS

2011/0102963 A1* 5/2011 Sekoguchi ..... F24F 8/192 361/230
2011/0115362 A1* 5/2011 Sekoguchi ..... H01T 23/00 313/230
2014/0239837 A1* 8/2014 Date ..... H01T 23/00 315/219
2015/0083931 A1* 3/2015 Temporin ..... H01T 23/00 250/426
2018/0053620 A1* 2/2018 Nishida ..... A61L 9/22

FOREIGN PATENT DOCUMENTS

JP 2011-037650 A 2/2011
JP 2013-004416 A 1/2013
WO WO-2008004454 A1 * 1/2008 ..... H01T 23/00

* cited by examiner

*Primary Examiner* — Raymond R Chai
(74) *Attorney, Agent, or Firm* — ScienBiziP, P.C.

(57) ABSTRACT

An ion generator includes a high-voltage transformer having a secondary side that is not grounded; a discharge wire-pattern; an induction wire-pattern; a discharge electrode connected to a first terminal via the discharge wire-pattern, the first terminal being disposed on the secondary side of the high-voltage transformer; and an induction electrode connected to a second terminal via the induction wire-pattern, the second terminal being disposed on the secondary side of the high-voltage transformer. The first terminal has a first width. The discharge wire-pattern includes a discharge wide region having a second width greater than the first width. The discharge wide region and the induction wire-pattern at least partly overlap each other in plan view.

5 Claims, 3 Drawing Sheets

ION GENERATOR AND ELECTRIC APPARATUS

CROSS-REFERENCE TO RELATED APPLICATION

The present application claims priority from Japanese Application JP2019-90005, the content to which is hereby incorporated by reference into this application.

BACKGROUND OF THE INVENTION

Field of the Invention

One aspect of the present invention relates to an ion generator and an electric apparatus that includes the ion generator.

Description of the Background Art

Japanese Patent Application Laid-Open No. 2011-37650 discloses an ozone generator that includes a pulse generator capable of generating a pulse voltage, multiple electrodes that receive the pulse voltage, and a discharge responder that generates ozone by electric discharge that occurs between the electrodes. The ozone generator includes a first shield covering a magnetic-pulse compression circuit located within the pulse generator, and includes a second shield independent of the first shield.

Japanese Patent Application Laid-Open No. 2013-4416 discloses an ion generator that includes a power controller that controls the entire ion generator, and includes a high-voltage generating circuit that, under the control of the power controller, generates a high voltage to be applied to a discharge portion. In the ion generator, the power controller is disposed on a first substrate, and the high-voltage generating circuit is disposed on a second substrate, which is a location different from where the first substrate is disposed.

SUMMARY OF THE INVENTION

The ozone generator in Japanese Patent Application Laid-Open No. 2011-37650 unfortunately needs to include two shields independent of each other, in addition to components for ozone generation. The ozone generator is hence difficult to downsize.

The ion generator in Japanese Patent Application Laid-Open No. 2013-4416 can easily reduce a conducted noise among noises generated by the ion generator. To reduce radiated and induced noises, however, the first and second substrates need to be separate greatly from each other. The ion generator in Japanese Patent Application Laid-Open No. 2013-4416 is hence difficult to downsize.

It is an object of one aspect of the present invention to achieve an ion generator and other things that are small and can reduce a noise.

To solve the aforementioned problem, an ion generator according to one aspect of the present invention includes the following components: a high-voltage transformer having a secondary side that is not grounded; a discharge wire-pattern; an induction wire-pattern; a discharge electrode connected to a first terminal via the discharge wire-pattern, the first terminal being disposed on the secondary side of the high-voltage transformer, and an induction electrode connected to a second terminal via the induction wire-pattern, the second terminal being disposed on the secondary side of the high-voltage transformer. The first terminal has a first width. The discharge wire-pattern has a discharge wide region having a second width greater than the first width. The discharge wide region and the induction wire-pattern at least partly overlap each other in plan view.

The aspect of the present invention achieves an ion generator and other things that are small and can reduce a noise.

DETAILED DESCRIPTION OF THE INVENTION

First Preferred Embodiment

The following details a preferred embodiment of the present invention.

Figure 2:
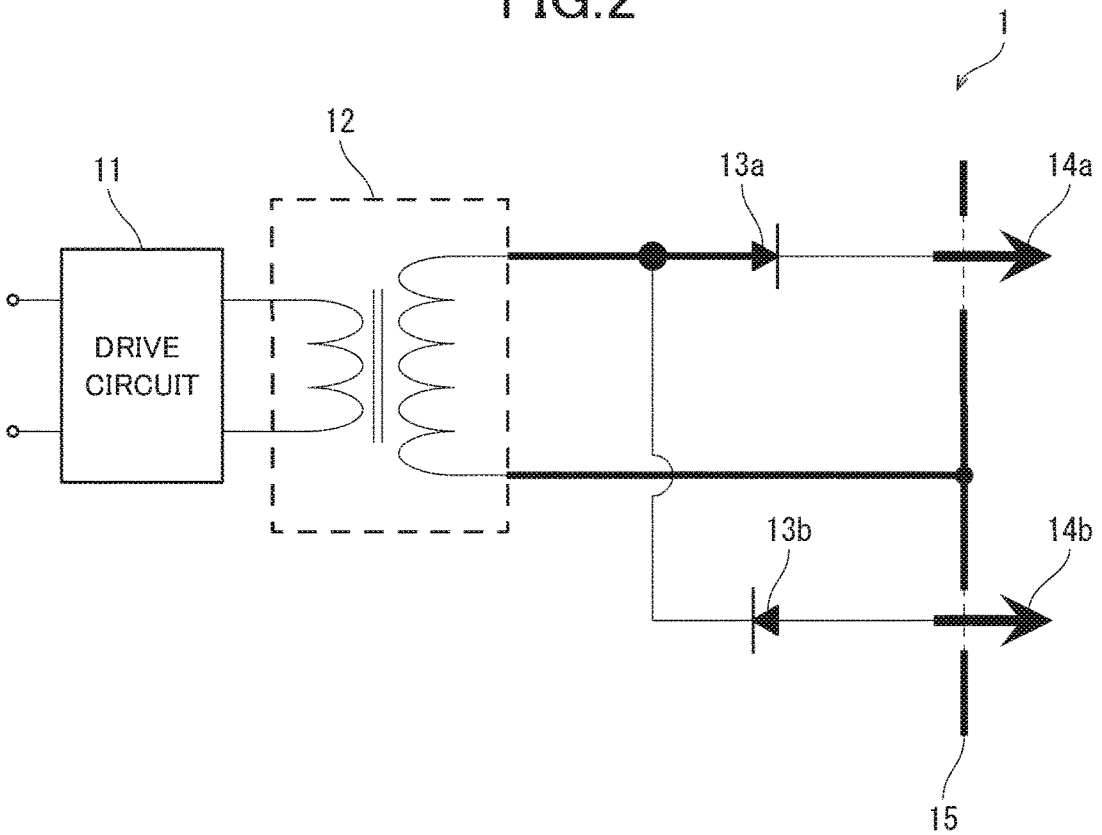
FIG. 2 schematically illustrates the circuit configuration of the ion generator according to the first preferred embodiment.

FIG. 2 schematically illustrates the circuit configuration of an ion generator 1 according to this preferred embodiment. As illustrated in FIG. 2, the ion generator 1 includes a drive circuit 11, a high-voltage transformer 12, diodes 13*a* and 13*b*, discharge electrodes 14*a* and 14*b*, and induction electrodes 15.

The drive circuit 11 is used for driving the high-voltage transformer 12 using an external input voltage. The high-voltage transformer 12 is used for boosting the input voltage when driven by the drive circuit 11.

The diodes 13*a* and 13*b* are connected in parallel between a terminal 12*a* (c.f., FIG. 3A-FIG. 3C), one of terminals of the high-voltage transformer 12, and the discharge electrodes 14*a* and 14*b*. That is, the high-voltage transformer 12 and the discharge electrodes 14*a* and 14*b* are connected together via the diodes 13*a* and 13*b*. The anode of the diode 13*a* and the cathode of the diode 13*b* are connected to the terminal 12*a*. The cathode of the diode 13*a* is connected to the discharge electrode 14*a*. The anode of the diode 13*b* is connected to the discharge electrode 14*b*.

The discharge electrodes 14*a* and 14*b* are used for forming an electric field between these electrodes and the induction electrodes 15. The discharge electrode 15*a* is used for forming an electric field between the induction electrodes 15 and the discharge electrodes 14*a* and 14*b*.

In the ion generator 1, the high-voltage transformer 12 has a secondary side that is not grounded. Power supply from the drive circuit 11 to the high-voltage transformer 12 causes electric discharge between the discharge electrodes 14*a* and 14*b* and the induction electrodes 15, thus generating ions. Each component of the circuit of the ion generator 1 is non-limiting; anything that is publicly known can be used as the component.

Figure 1:
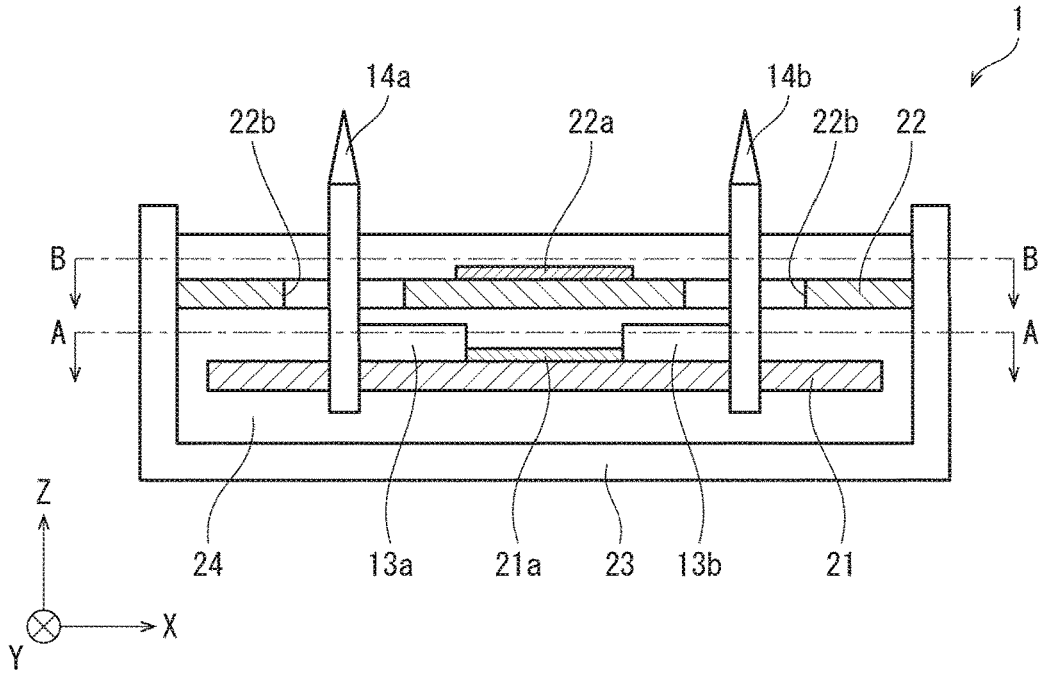
FIG. 1 illustrates the configuration of an ion generator according to a first preferred embodiment.

FIG. 1 schematically illustrates the configuration of the ion generator 1 according to this preferred embodiment. As illustrated in FIG. 1, the ion generator 1 includes a discharge substrate 21, an induction substrate 22, a case 23, and a resin sealant 24, in addition to the components illustrated in FIG. 2. The case 23 contains the discharge substrate 21 and induction substrate 22. The resin sealant 24 is used for sealing the discharge substrate 21 and induction substrate 22 within the case 23.

The discharge substrate 21 and induction substrate 22 need to be made of a material used for a typical circuit substrate. The case 23 is made of, but not limited to, polybutylene terephthalate (PBT) resin, polyphenylene ether (PPE) resin, or polycarbonate (PC) resin. The resin sealant 24 is made of, but not limited to, epoxy resin or urethane resin. For simplification, the resin sealant 24 is omitted in FIGS. 3 (*a*), (*b*), and (*c*), which will be described later on.

The discharge substrate 21 has a surface on which a discharge wire-pattern 21*a*, the diodes 13*a* and 13*b*, and the discharge electrodes 14*a* and 14*b* are disposed. The discharge wire-pattern 21*a* is a circuit pattern that supplies power from the high-voltage transformer 12 to the discharge electrodes 14*a* and 14*b*.

Examples of the discharge electrodes 14*a* and 14*b* include a brush electrode, needle electrode, and planar electrode. Hereinafter, the surface on which the discharge electrodes 14*a* and 14*b* are disposed (i.e., the surface in +Z-direction in each drawing) can be referred to as an upper surface of the discharge substrate 21, and a surface opposite to the upper surface can be referred to as a lower surface of the same.

The induction substrate 22 has a surface on which an induction wire-pattern 22*a* and the induction electrodes 15 are disposed. The induction wire-pattern 22*a* is a circuit pattern that supplies power from the high-voltage transformer 12 to the induction electrodes 15. The induction substrate 22 is disposed above the discharge substrate 21. The induction substrate 22 has holes 22*b* through which the discharge electrodes 14*a* and 14*b* extend.

The induction electrodes 15 are annular, planar electrodes having their centers at which the respective discharge electrodes 14*a* and 14*b* are disposed. Each portion included in the induction electrode 15 is thus away from the discharge electrode 14*a* or 14*b* by a substantially fixed distance. Electric discharge accordingly occurs between the entire induction electrode 15 and the discharge electrode 14*a* or 14*b*, thereby achieving stable, electric discharge. It is noted that each induction electrode 15, although, in this preferred embodiment, being a planar electrode having an annular shape for achieving stable, electric discharge, does not necessarily have to be annular. It is also noted that each induction electrode 15 does not necessarily have to be a planar electrode.

Figure 3A:
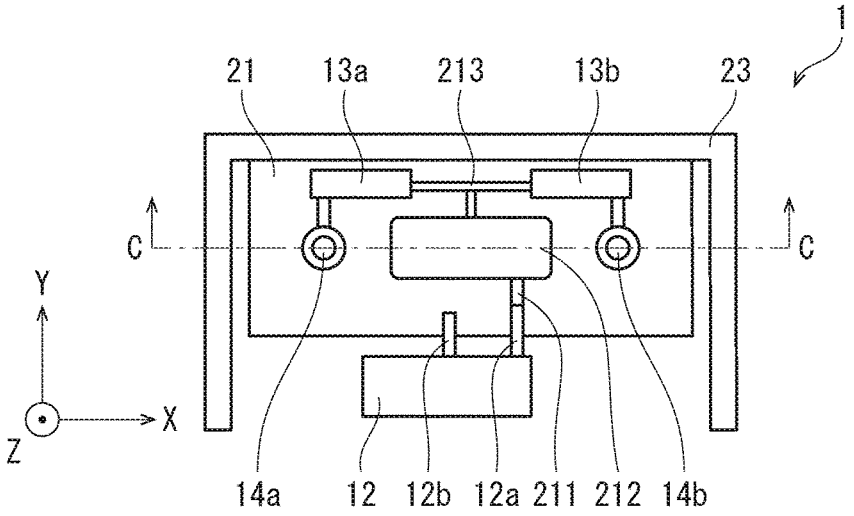
FIG. 3A is a cross-sectional view taken along line A-A in FIG. 1.

FIG. 3A is a cross-sectional view taken along line A-A in FIG. 1. FIG. 1 is a cross-sectional view taken along line C-C in FIG. 3A. In the ion generator 1, the discharge electrodes 14*a* and 14*b* are connected to the terminal 12*a* (i.e., one of terminals on the secondary side of the high-voltage transformer 12) via the discharge wire-pattern 21*a*. As illustrated in FIG. 3A, the discharge wire-pattern 21*a* has a transformer connection-region 211, a wide region 212 (i.e., a discharge wide region), and a diode connection-region 213. The transformer connection-region 211 is a region where the terminal 12*a* is connected to the discharge wire-pattern 21*a*. The transformer connection-region 211 has a width equal to the width of the terminal 12*a* (i.e., a first width). The diode connection-region 213 is a region where the diodes 13*a* and 13*b* are connected to the discharge wire-pattern 21*a*.

The wide region 212 is between the transformer connection-region 211 and diode connection-region 213. The wide region 212 has a width (i.e., a second width) greater than the width of the terminal 12*a* of the high-voltage transformer 12.

Figure 3B:
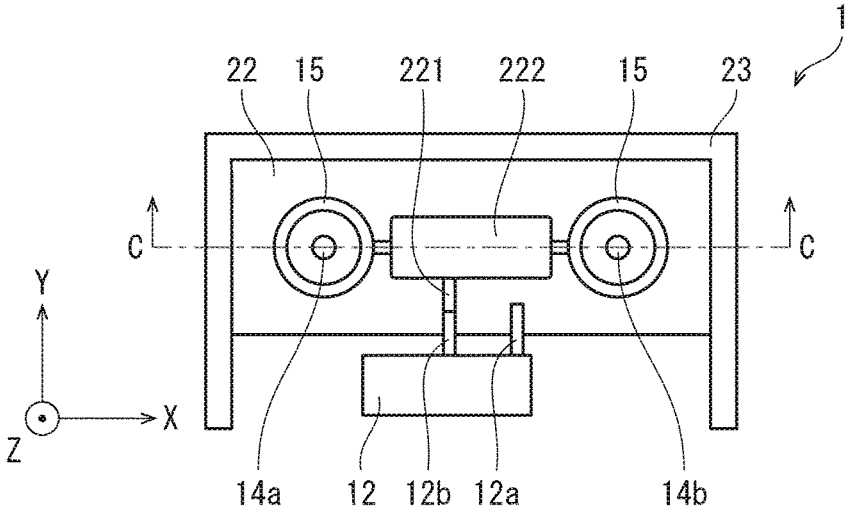
FIG. 3B is a cross-sectional view taken along line B-B in FIG. 1.

FIG. 3B is a cross-sectional view taken along line B-B in FIG. 1. In the ion generator 1, the induction electrodes 15 are connected to a terminal 12*b* via the induction wire-pattern 22*a*. The terminal 12*b* is the other of the terminals on the secondary side of the high-voltage transformer 12. As illustrated in FIG. 3B, the induction wire-pattern 22*a* has a transformer connection-region 221 and a wide region 222 (i.e., an induction wide region). The transformer connection-region 211 is a region where the other terminal 12*b* of the high-voltage transformer 12 is connected to the induction wire-pattern 22*a*. The transformer connection-region 221 has a width equal to the width of the terminal 12*b* (i.e., a third width).

The wide region 222 is between the transformer connection-region 221 and induction electrodes 15. The wide region 212 has a width (i.e., a fourth width) greater than the width of the terminal 12*b*. It is noted that the widths of the terminals 12*a* and 12*b* may or may not be the same.

The discharge wire-pattern 21*a* does not necessarily have to have the transformer connection-region 211 and/or diode connection-region 213, and the terminal 12*a* and/or diode 13*a* may be connected directly to the wide region 212. Likewise, the induction wire-pattern 22*a* does not necessarily have to have the transformer connection-region 221, and the terminal 12*b* may be connected directly to the wide region 222. In view of easy manufacture of the ion generator 1, however, the discharge wire-pattern 21*a* preferably has the transformer connection-region 211 and diode connection-region 213, and the induction wire-pattern 22*a* preferably has the transformer connection-region 221.

When the discharge wire-pattern 21*a* has the transformer connection-region 211 and/or diode connection-region 213, this region does not necessarily have to be as wide as the terminal 12*a* and/or the terminal of the diode 13*a*. Likewise, when the induction wire-pattern 22*a* has the transformer connection-region 221, this region does not necessarily have to be as wide as the terminal 12*b*. In view of easy manufacture of the ion generator 1, however, the transformer connection-region 211 and diode connection-region 213 are preferably as wide as the terminal 12*a* and the terminal of the diode 13*a*, and the transformer connection-region 221 is preferably as wide as the terminal 12*b*.

When the transformer connection-region 211 and/or diode connection-region 213 is not as wide as the terminal 12*a* and/or the terminal of the diode 13*a*, the wide region 212 is preferably formed to be wider than the transformer connection-region 211 and/or diode connection-region 213. Likewise, when the transformer connection-region 221 is not as wide as the terminal 12*b*, the wide region 222 is preferably formed to be wider than the terminal 12*b*.

Figure 3C:
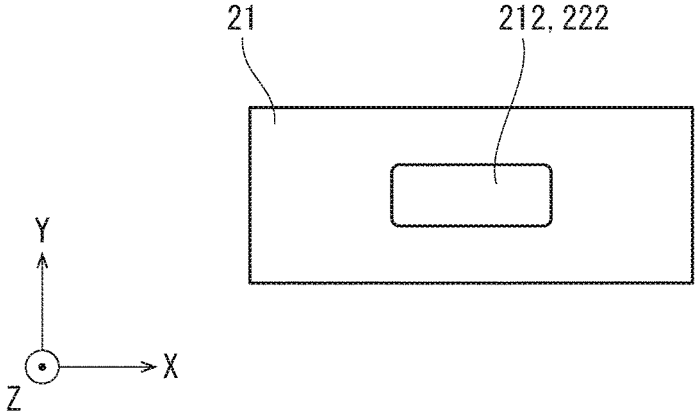
FIG. 3C illustrates the positional relationship in plan view between a wide region of a discharge wire-pattern and a wide region of an induction wire-pattern.

FIG. 3C illustrates the positional relationship in plan view between the wide regions 212 and 222. FIG. 3C shows the discharge substrate 21 as well. As illustrated in FIG. 3C, the wide regions 212 and 222 overlap each other in plan view. The wording "in plan view" herein means that viewing the wide regions 212 and 222 from above in a direction perpendicular to the discharge substrate 21 and induction substrate 22. It is noted that the wide regions 212 and 222 need to at least partly overlap each other in plan view, and does not have to be superposed on each other.

In this preferred embodiment, the wide region 212 is disposed closer to the high-voltage transformer 12 than the diodes 13*a* and 13*b*. A region closer to the high-voltage transformer 12 than the diodes 13*a* and 13*b* has a long current path when compared to a region closer to the discharge electrodes 14*a* and 14*b* than the diodes 13*a* and 13*b*. Hence, forming the wide region 212 in a region closer to the high-voltage transformer 12 than the diodes 13*a* and 13*b* can widen the wide region 212. The region where the wide region 212 and wide region 222 overlap each other can be thus widened, thereby achieving further noise reduction.

In the ion generator 1, the secondary side of the high-voltage transformer 12 is not grounded, as earlier described. A noise that occurs in the discharge wire-pattern 21*a* and a noise that occurs in the induction wire-pattern 22*a* hence exhibit their waveforms having phases opposite from each other. In the ion generator 1, the discharge wire-pattern 21*a* and induction wire-pattern are at least partly overlap each other in plan view. Thus, the noise in the discharge wire-pattern 21*a* and the noise in the induction wire-pattern 22*a* at least partly cancel out each other. This configuration reduces a noise that, for instance, enters the drive circuit 11 of the ion generator 1, or enters a control circuit of an electric apparatus that includes the ion generator 1. This configuration also eliminates the need for additional components, such as a shield. Consequently, the ion generator 1 can be configured at lower cost than an ion generator that includes such additional components.

In the ion generator 1, the induction wire-pattern 22*a* does not necessarily have to have the wide region 222. For the induction wire-pattern 22*a* without the wide region 222, the wide region 212 of the discharge wire-pattern 21*a* and the induction wire-pattern 22*a* at least partly overlap each other in plan view, thereby reducing a noise.

In the foregoing example, the discharge wire-pattern 21*a* is disposed on the upper surface of the discharge substrate 21, and the induction wire-pattern 22*a* is disposed on the upper surface of the induction substrate 22. In some preferred embodiments, the discharge wire-pattern 21*a* may be disposed on the lower surface of the discharge substrate 21, and the induction wire-pattern 22*a* may be disposed on the lower surface of the induction substrate 22.

An electric apparatus according to this preferred embodiment includes the ion generator 1. Examples of the electric apparatus according to this preferred embodiment include an air conditioner, air purifier, hair dryer, vacuum cleaner, refrigerator, and washing machine. Each of these electric apparatuses, which includes the ion generator 1, reduces noise entrance into its control circuit and other components. This configuration provides an inexpensive and small electric apparatus, and can reduce possible malfunctioning of the electric apparatus resulting from a noise.

Second Preferred Embodiment

The following describes another preferred embodiment of the present invention. For the sake of convenience in description, components whose functions are the same as those of the components described in the foregoing preferred embodiment are denoted by the same sings and will not be elaborated upon.

Figure 4:
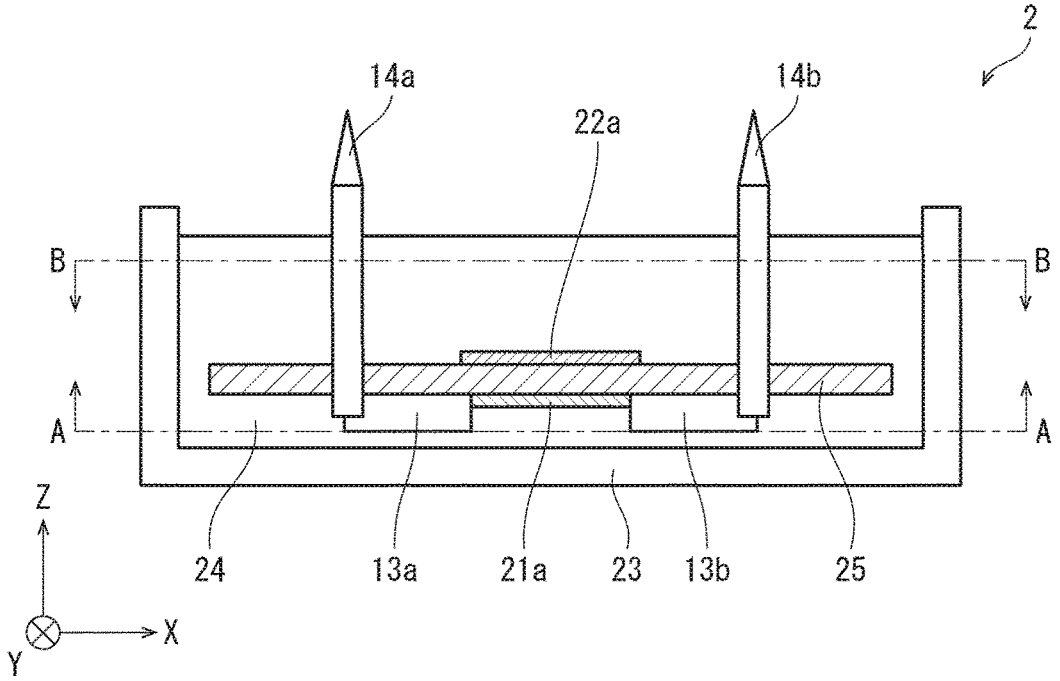
FIG. 4 illustrates the configuration of an ion generator according to a second preferred embodiment.

FIG. 4 schematically illustrates the configuration of an ion generator 2 according to this preferred embodiment. The ion generator 2 is different from the ion generator 1 in that the ion generator 2 includes a single substrate 25 instead of the discharge substrate 21 and induction substrate 22, as illustrated in FIG. 4. The substrate 25 may be made of a material similar to that of the discharge substrate 21 and induction substrate 22.

In the ion generator 2, the discharge wire-pattern 21*a* is disposed on the lower surface of the substrate 25, as illustrated in FIG. 4. In addition, the induction wire-pattern 22*a* is disposed on the upper surface of the substrate 25. In some embodiments, such placement of these components may be reverse. That is, the discharge wire-pattern 21*a* may be disposed on the upper surface of the substrate 25; and the induction wire-pattern 22*a*, on the lower surface of the same. In other words, the ion generator 2 is configured such that the discharge wire-pattern 21*a* and the induction wire-pattern 22*a* are disposed on mutually different surfaces of the same substrate 25. Herein, the cross-section taken along line A-A in FIG. 4 is similar to the cross-section taken along line A-A in FIG. 1, that is, FIG. 3A, except for the direction of the coordinate axis. In addition, the cross-section taken along line B-B in FIG. 4 is similar to the cross-section taken along line B-B in FIG. 1, that is, FIG. 3B.

The ion generator 2 can reduce a noise as is the case with the ion generator 1. Furthermore, the ion generator 2 includes less components and can be thus smaller than the ion generator 1.

Third Preferred Embodiment

Figure 5:
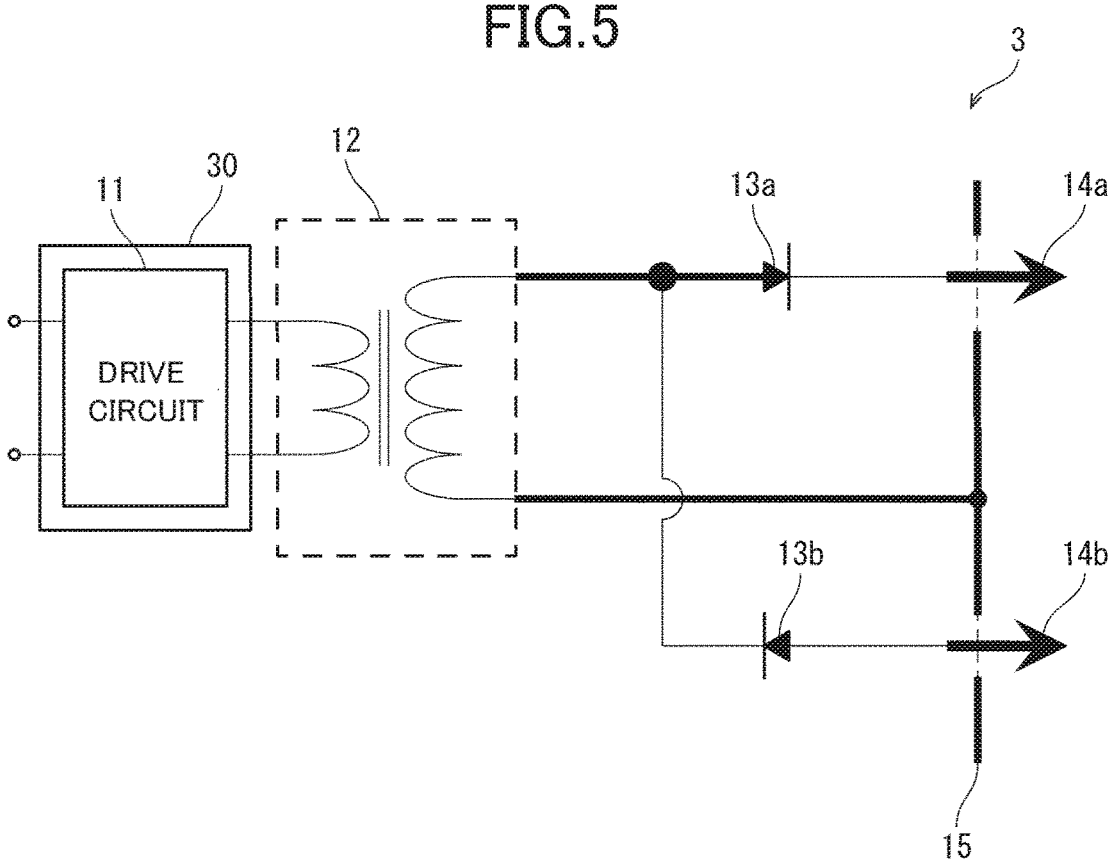
FIG. 5 schematically illustrates the circuit configuration of an ion generator according to a third preferred embodiment.

FIG. 5 schematically illustrates the circuit configuration of an ion generator 3 according to still another preferred embodiment of the present invention. As illustrated in FIG. 5, the ion generator 3 includes a shield 30 in addition to the components of the ion generator 1. The shield 30 shields the drive circuit 11, disposed on the primary side of the high-voltage transformer 12, from an electromagnetic noise that occurs in the discharge wire-pattern 21*a* and induction wire-pattern 22*a*. The shield 30 may be disposed to surround the drive circuit 11 for instance, as illustrated in FIG. 5. Alternatively, the shield 30 may be disposed between the drive circuit 11 and high-voltage transformer 12. Alternatively, the shield 30 may be disposed to surround the high-voltage transformer 12.

The ion generator 3, which is configured in a manner similar to the ion generator 1, reduces a noise. The shield 30 can be thus simply configured when compared to, for instance, the ozone generator disclosed in Japanese Patent Application Laid-Open No. 2011-37650. Consequently, the ion generator 3 can be smaller than a conventional apparatus such as the one in Japanese Patent Application Laid-Open No. 2011-37650, and can reduce a noise better than the ion generator 1 or 2.

Instead of the ion generator 1, the ion generator according to this preferred embodiment may be the ion generator 2 modified to include the shield 30.

SUMMARY

An ion generator according to a first aspect of the present invention includes the following components: a high-voltage transformer having a secondary side that is not grounded; a discharge wire-pattern; an induction wire-pattern; a discharge electrode connected to a first terminal via the discharge wire-pattern, the first terminal being disposed on the secondary side of the high-voltage transformer, and an induction electrode connected to a second terminal via the induction wire-pattern, the second terminal being disposed on the secondary side of the high-voltage transformer. The first terminal has a first width. The discharge wire-pattern has a discharge wide region having a second width greater than the first width. The discharge wide region and the induction wire-pattern at least partly overlap each other in plan view.

In this configuration, the secondary side of the high-voltage transformer is not grounded. Accordingly, a noise that occurs in the discharge wire-pattern and a noise that occurs in the induction wire-pattern exhibit their waveforms having phases opposite from each other. The configuration where the discharge wide region and induction wire-pattern at least partly overlap each other cancels out at least some of these noises. Consequently, a small ion generator is achieved that can reduce a noise, without using a shield and other components for noise blockage.

An ion generator according to a second aspect of the present invention may be configured, in the first aspect, such that the high-voltage transformer and the discharge electrode are connected together via a diode, and such that the discharge wide region is disposed closer to the high-voltage transformer than the diode.

A region closer to the high-voltage transformer than the diode typically has a long current path when compared to a region closer to the discharge electrode than the diode. In the aforementioned configuration, the discharge wide region is disposed closer to the high-voltage transformer than the diode. This enables the region where the discharge wide region and induction wire-pattern overlap, to be widened. Consequently, a noise can be further reduced.

An ion generator according to a third aspect of the present invention may be configured, in the first or second aspect, such that the second terminal has a third width. In addition, the ion generator may be configured such that the induction wire-pattern has an induction wide region having a fourth width greater than the third width. In addition, the ion generator may be configured such that the discharge wide region and the induction wide region at least partly overlap each other in plan view.

In the aforementioned configuration, the discharge wide region and induction wide region overlap each other, thus increasing the area of the overlapping region. Consequently, a noise can be further reduced.

An ion generator according to a fourth aspect of the present invention may be configured, in any of the first to third aspects, such that the discharge wire-pattern and the induction wire-pattern are disposed on mutually different surfaces of the same substrate.

The aforementioned configuration uses less components and achieves a smaller ion generator than a configuration where the discharge wire-pattern and induction wire-pattern are disposed on separate substrates.

An ion generator according to a fifth aspect of the present invention may be configured, in any of the first to fourth aspects, to further include a shield that shields a drive circuit from an electromagnetic noise that occurs in the discharge wire-pattern and induction wire-pattern, the drive circuit being disposed on the primary side of the high-voltage transformer.

In the aforementioned configuration, the discharge wide region and the induction wire-pattern at least partly overlap each other, thus reducing a noise, and this noise is further blocked by the shield. This instance can simplify the configuration of the shield per se when compared to an instance where a noise that is not reduced is blocked. Consequently, the ion generator can be smaller and reduce a noise better than a conventional ion generator.

An electric apparatus according to a sixth aspect of the present invention includes the ion generator according to any of the first to fifth aspects.

In the aforementioned configuration, a small ion generator is included that can reduce a noise. This configuration can thus provide a small electric apparatus that can prevent malfunctioning due to a noise from the ion generator.

While there have been described what are at present considered to be certain embodiments of the invention, it will be understood that various modifications may be made thereto, and it is intended that the appended claims cover all such modifications as fall within the true spirit and scope of the invention.

What is claimed is:

1. An ion generator comprising:

a high-voltage transformer comprising a secondary side that is not grounded;

a discharge wire-pattern;

an induction wire-pattern;

a discharge electrode connected to a first terminal via the discharge wire-pattern, the first terminal being disposed on the secondary side of the high-voltage transformer; and an induction electrode connected to a second terminal via the induction wire-pattern, the second terminal being disposed on the secondary side of the high-voltage transformer, wherein the first terminal has a first width, the discharge wire-pattern comprises a discharge wide region having a second width greater than the first width, and the discharge wide region and the induction wire-pattern at least partly overlap each other in a plan view.

2. The ion generator according to claim 1, wherein the high-voltage transformer and the discharge electrode are connected together via a diode, and the discharge wide region is disposed closer to the high-voltage transformer than the diode.

3. The ion generator according to claim 1, wherein the second terminal has a third width, the induction wire-pattern comprises an induction wide region having a fourth width greater than the third width, and the discharge wide region and the induction wide region at least partly overlap each other in a plan view.

4. The ion generator according to claim 1, wherein the discharge wire-pattern and the induction wire-pattern are disposed on mutually different surfaces of the same substrate.

5. The ion generator according to claim 1, further comprising a shield that shields a drive circuit from an electromagnetic noise that occurs in the discharge wire-pattern and induction wire-pattern, the drive circuit being disposed on a primary side of the high-voltage transformer.

* * * * *